US008376418B2

(12) United States Patent
Osvatic et al.

(10) Patent No.: US 8,376,418 B2
(45) Date of Patent: Feb. 19, 2013

(54) GASKET-COMPENSATING LATCH MECHANISM

(75) Inventors: Michael S. Osvatic, Waukesha, WI (US); Kenyon A. Hapke, Libertyville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 601 days.

(21) Appl. No.: 12/529,308

(22) PCT Filed: May 22, 2008

(86) PCT No.: PCT/US2008/064506

§ 371 (c)(1), (2), (4) Date: Aug. 31, 2009

(87) PCT Pub. No.: WO2008/147870

PCT Pub. Date: Dec. 4, 2008

(65) Prior Publication Data

US 2010/0052338 A1 Mar. 4, 2010

Related U.S. Application Data

(60) Provisional application No. 60/939,958, filed on May 24, 2007.

(51) Int. Cl.
*E05C 3/16* (2006.01)
*E05C 3/06* (2006.01)

(52) U.S. Cl. ..... 292/216; 292/71; 292/198; 292/201; 292/DIG. 69

(58) Field of Classification Search ..... 292/216, 292/332–336, 59, 65–68, 71, 96, 98, 117, 292/122, 124, 128, 129, 197, 198, 201, 209, 292/210, 214, 215, 220, 222, 224, 226, 341.15, 209/341.16, DIG. 24, DIG. 41, DIG. 69
See application file for complete search history.

(56) References Cited

U.S. PATENT DOCUMENTS

| | | | | |
|---|---|---|---|---|
| 1,694,023 | A * | 12/1928 | Suck | 292/99 |
| 1,858,345 | A * | 5/1932 | Spindler | 292/98 |
| 2,833,578 | A | 5/1958 | Burke | |
| 4,497,513 | A | 2/1985 | Sasaki | |
| 5,004,276 | A * | 4/1991 | Hanley | 292/126 |
| 5,062,668 | A * | 11/1991 | Onderka et al. | 292/25 |
| 5,090,751 | A * | 2/1992 | Kobayashi | 292/71 |
| 5,518,282 | A * | 5/1996 | Sawada | 292/252 |
| 6,036,241 | A * | 3/2000 | Ostdiek et al. | 292/229 |
| 6,290,270 | B1 | 9/2001 | Spiessl | |
| 6,390,518 | B1 * | 5/2002 | Elick | 292/216 |
| 7,040,673 | B2 * | 5/2006 | Smock et al. | 292/109 |
| 7,306,266 | B2 | 12/2007 | Hapke et al. | |
| 2002/0073752 | A1 * | 6/2002 | Dirnberger et al. | 70/266 |
| 2005/0194795 | A1 * | 9/2005 | Hapke et al. | 292/216 |
| 2006/0087128 | A1 * | 4/2006 | Salice | 292/163 |
| 2008/0276672 | A1 * | 11/2008 | Gartner | 70/277 |

OTHER PUBLICATIONS

ISR for PCT/US2008/064506 mailed Dec. 10, 2008.

* cited by examiner

*Primary Examiner* — Carlos Lugo
*Assistant Examiner* — Alyson M Merlino
(74) *Attorney, Agent, or Firm* — Lowe Hauptman Ham & Berner, LLP

(57) ABSTRACT

A latch for an appliance or the like provides a floating bolt assembly spring biasing a door against a sealing gasket in different positions depending on gasket compliance. A lock provides a stop that may adjustably bridge a distance between the latch frame and the floating bolt assembly as the gasket ages thereby providing positive locking of the door over the life of the appliance.

17 Claims, 5 Drawing Sheets

GASKET-COMPENSATING LATCH MECHANISM

RELATED APPLICATIONS

The present application is based on International Application Number PCT/US2008/064506 filed May 22, 2008, and claims priority from U.S. Provisional Application No. 60/939,958 filed May 24, 2007, the disclosures of which are hereby incorporated by reference herein in their entirety.

STATEMENT REGARDING FEDERALLY SPONSORED RESEARCH OR DEVELOPMENT

Background of the Invention

The present invention relates to a latching mechanism for doors on household appliances and particularly to locking latching mechanisms that accommodate changes in the compression of a door gasket.

Appliances such as dishwashers and front-loading washing machines may have an access door with a gasket that must be compressed to seal water within a washing chamber. Small area, highly compliant gaskets may be sealed by pressure from the user during the closing of the door. The gasket may then be held in a compressed state by a latch mechanism.

Gaskets that require more force may be compressed by a latch mechanism having a lever operated by the user to engage a catch and draw the catch inward with a lever advantage to compress the gasket and hold the door shut.

A closing lever may be avoided in latch mechanisms that provide an "over-center" spring mechanism. During initial stages of closing of the door, closing force on the door is used to energize a spring. When the door closes past the over-center point, the spring releases its energy in a manner to pull the door fully closed. An example of an over-center spring mechanism is described in U.S. Pat. No. 4,497,513 to Sasaki.

A variation on the over-center spring mechanism stores energy in a spring as the door is opened and holds that energy until the door is closed again. An over-center design is still employed and therefore a slight compression of the spring is required when the door is closed to release the energy. A latch of this kind is disclosed in U.S. Pat. No. 2,833,578 to Burke.

U.S. Pat. No. 6,290,270 to Spiessl shows a variation on Burke in which the latch spring is compressed when the door is opened and this energy is released when the door is closed, assisting the user in compressing the door gasket. In this design, the latching mechanism "floats" on a spring-loaded lever to accommodate aging of the gasket. As the gasket ages and compresses more, the latching mechanism moves further "inboard" on the spring-loaded lever to ensure complete closure.

U.S. Pat. Application No. 2005/0194795 to Hapke, assigned to the assignee of the present invention and hereby incorporated by reference, teaches an improvement on the Spiessl design that employees a sliding carriage in lieu of the lever. The carriage allows the spring force to be more evenly distributed permitting increased use of molded thermoplastic rather than metallic components.

Modern appliances may require locking of the appliance door during certain stages of the washing cycle, for example, when it is likely that opening the door would release water or present a hazard to the user. The Hapke application teaches implementing a lock in an appliance latch by using a stop connected to a bi-directional solenoid. The bi-directional solenoid has one coil for moving a stop to block opening of the latch and a second opposed coil for retracting the stop to release the latch. The Hapke and Spiessl latches release by movement of the floating latch mechanism "outboard" toward the door. Thus, the latch may be locked simply by blocking this movement with a stop positioned between the floating latch mechanism and a fixed frame member.

In the "floating" latch designs described above, where the latch mechanism moves as the gasket ages, a locking stop must be positioned so that it will engage and thus block the latch mechanism when the gasket is new and the latch mechanism floats in an extreme "outboard" position. As the gasket ages, this stop location allows a slight opening of the door that could permit water leakage around the aged gasket.

SUMMARY OF THE INVENTION

The present invention provides a stop mechanism that automatically accommodates inboard movement in "floating" latch mechanisms as the gasket ages by variably bridging different axial separations between the latch frame and the floating carriage. In a preferred embodiment this stop is wedge-shaped so that lateral motion can bridge any given axial separation distance.

In another embodiment, the present invention provides an improved hook cam designed for such floating latch mechanisms. The hook cam must be rotated to release the latch against a frictional contact between the hook cam and a stationary pin. In this embodiment, the hook cam provides an actuation lever having an extended lever arm that reduces the force needed to rotate the hook cam. A slider element allows the extended lever arm to be actuated by the latch strike, the latter which must be close to the center of the hook cam in order to engage with the hook.

The present invention further provides an actuator for a locking stop that employs a single acting solenoid to both lock and unlock the latch without consuming power when the latch resides in either the locked or unlocked state.

Specifically then, the invention may provide a locking appliance latch for receiving a strike to hold a gasketed door closed. The latch includes a latch frame attached to the appliance supporting a carriage spring-biased in a door closing direction. A bolt (for example, a rotating hook) held by the carriage may releasably engage a strike (for example, a U-shaped loop) to pull the door against the gasket. A stop may be moved to a lock position to bridge a separation distance between the carriage and latch frame for a range of distances between the carriage and the latch frame. An electric actuator moves the stop between the lock position and an unlocked position removed from bridging the carriage and latch frame.

It is thus an object of at least one embodiment of the invention to provide a stop for a floating latch design that prevents leakage as a gasket ages when the locked door is pulled.

The stop may be a wedge laterally movable in a direction perpendicular to an axial separation between the carriage and latch frame to bridge the distance between the carriage and latch frame for the range of axial distances.

It is thus an object of at least one embodiment of the invention to provide a simple adjustment mechanism that employs lateral movement to change an effective axial stop width.

The wedge may include a set of teeth engaging corresponding teeth on an opposed a wedge on the carriage.

It is thus an object of at least one embodiment of the invention to eliminate the need for high contact forces between the wedges as would be required if one were to rely on frictional resistance to sliding.

The teeth may have lateral faces.

It is thus an object of at least one embodiment of the invention to permit substantially zero force engagement and disengagement between the stop and carriage.

The lateral motion may be provided by rotary motion of a stop support.

It is thus an object of at least one embodiment of the invention to provide an extremely compact stop system.

The stop may provide multiple wedges rotatable about a common center to laterally engage corresponding wedges on the carriage to bridge the axial separation between the carriage and latch frame for the range of axial separations.

It is thus an object of at least one embodiment of the invention to permit the present device to be manufactured of moldable thermoplastic material by distributing the stop forces among multiple stops.

The spring biasing may be provided by a single helical spring surrounding the bolt and strike when the bolt and strike are engaged.

It is thus an object of at least one embodiment of the invention to provide a spring distributed over a broad area and thus suitable for use with thermoplastic components.

The stop may attach to the carriage when in the locked position to move with the carriage, without further lateral engaging motion away from abutment with the latch frame when the carriage moves in the door opening direction.

It is thus an object of at least one embodiment of the invention to prevent increasing the bridging separation provided by the stop (and the forces necessary to release the stop) if the door is pressed inward when the door is in a locked condition.

The invention may provide a guide track returning the stop to abutment with the latch frame when the stop is moved to the unlocked position.

It is thus an object of at least one embodiment of the invention to ensure disengagement of the stop in the unlocked condition.

The carriage and the stop may be constructed of moldable thermoplastic.

It is thus an object of at least one embodiment of the invention to produce a design suitable for use with thermoplastic materials subject to cold flow and strength limits.

In one embodiment, the invention may provide the appliance latch with a floating carriage supported by a latch frame and spring biased in a door closing direction. A bolt held by the carriage may releasably engage a strike to pull a door against a gasket under the spring biasing of the carriage. The bolt may provide a rotating hook having: (a) a hook portion for engaging the strike; (b) a constant radius portion abutting a stop fixed to the latch frame before the hook portion engages the strike to hold the carriage against its spring biasing with a biasing spring under compression; (c) an actuation arm rotating the bolt through force applied at a first point on the actuation by closing of the door, the first point on the actuation arm being outside of a second point of contact between the strike and the latch measured from a pivot point of the bolt.

It is thus an object of at least one embodiment of the invention to reduce the force necessary to close the door.

The latch may include a sliding element contacting the strike at a first point and contacting the actuation arm at a second point.

It is thus an object of at least one embodiment of the invention to allow the rotating force to be applied by the strike itself, even though the strike must be close to the hook cam to be engaged by the hook cam.

The bolt may be a moldable thermoplastic.

It is thus an object of at least one embodiment of the invention to provide a mechanism of reducing closure forces suitable for use with thermoplastic components.

In one embodiment, the invention may provide a locking appliance latch having a bolt assembly to engage a strike by moving from a first position to a second position and to release the strike by moving from the second position to the first position. A stop is provided that may move to a locked position to block movement of the bolt assembly from the second position to the first position, thereby to lock the latch, and which may further move to an unlocked position allowing movement of the bolt assembly from the second position to the first position, thereby to unlock the latch.

The stop may be driven by an actuator assembly moving the stop between the locked and unlocked position. The actuator assembly may include an electrical solenoid, energizable to provide an actuation force in only a single direction, attached to a bi-stable mechanical linkage positioned between the electrical solenoid and the stop. The bi-stable mechanical linkage operates to move the stop to the locked position with an initial actuation force/release and to move the stop to the unlocked position with a subsequent actuation force/release.

It is thus an object of at least one embodiment of the invention to permit a single solenoid to provide both unlocked and locked states of the stop without requiring power consumption in those states after the state transition is complete.

The bi-stable mechanical linkage may be a cardioid track traversed by a follower where one of the track and follower is fixed with respect to the latch frame.

It is thus an object of at least one embodiment of the invention to provide a compact mechanism that may be integrally molded into the components without substantially increasing the parts count.

The follower may be a ball held in a second track perpendicular to the actuation direction.

It is thus an object of at least one embodiment of the invention to provide a simple follower mechanism that may float within the tracks.

The invention may further include a spring biasing the solenoid in a direction opposed to the actuation force, and the bi-stable mechanism may control a spring biasing of the stop allowing the stop to be mechanically decoupled from the bi-stable mechanism.

It is thus an object of at least one embodiment of the invention to provide movement of the stop that may change depending on the separation between the floating carriage and the latch frame.

The bi-stable mechanism may be further coupled to a switch contact.

It is thus another object of at least one embodiment of the invention to provide an electrical indication of the state of the latch as locked or unlocked.

The solenoid may provide an extension of an operator with energizing of the solenoid.

It is thus an object of at least one embodiment of the invention to use a push type solenoid to eliminate interference with electrical contacts indicating the state of the switch.

These particular features and advantages may apply to only some embodiments falling within the claims and thus do not define the scope of the invention.

DETAILED DESCRIPTION OF THE INVENTION

Figure 1:
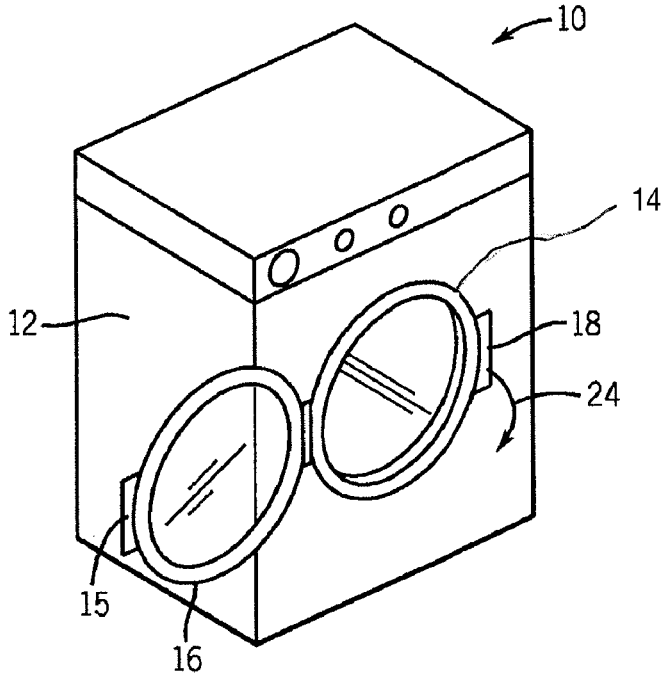
FIG. 1 is a simplified perspective view of an appliance suitable for use with the present invention showing the appliance door and one possible location of the latch elements.

Referring now to FIG. 1, an appliance 10 such as a washing machine may have a cabinet 12 opening along a front face to provide access to dishes within the interior of the cabinet 12. The front face may include a gasket 14 that is compressed with closure of a door 16 sized to cover the front face of the cabinet 12 to prevent access to its interior during operation and to prevent leakage of water during the wash cycle.

The door 16 may be hinged, for example, at a side edge and the opposite side edge held closed by means of a latch 18 held in the cabinet 12 and receiving a strike 15 attached to the door and extending toward the front face of the cabinet 12. It will be understood generally that the positions of the strike 15 and latch 18 may be reversed.

Figure 2:
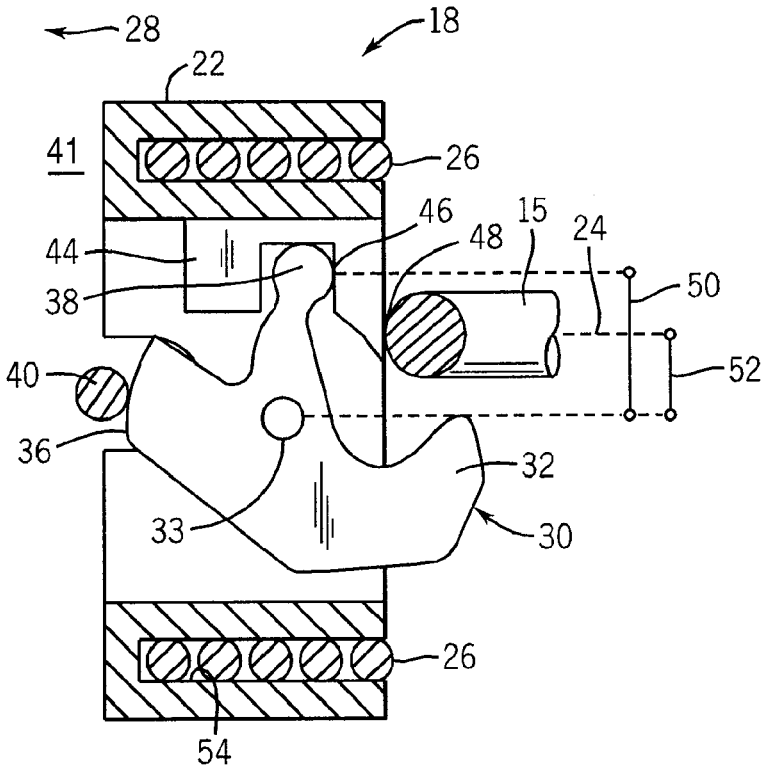
FIG. 2 is side elevational cross-section through a latch of the present invention showing a floating carriage forming part of the latch as positioned before receiving a strike to hold the door shut.

Referring now to FIGS. 1 and 2, the latch 18 may include a floating carriage 22, preferably molded of thermoplastic, and movable along an axis 24 along a direction of opening of the door 16 under the restraint of guide surfaces (not shown). The floating carriage 22 supports a hook cam 30 at its center, the hook cam 30 rotating about a pivot axis 33 generally perpendicular to the door-opening axis 24. The hook cam 30 may be molded of a self-lubricating thermoplastic.

Figure 4:
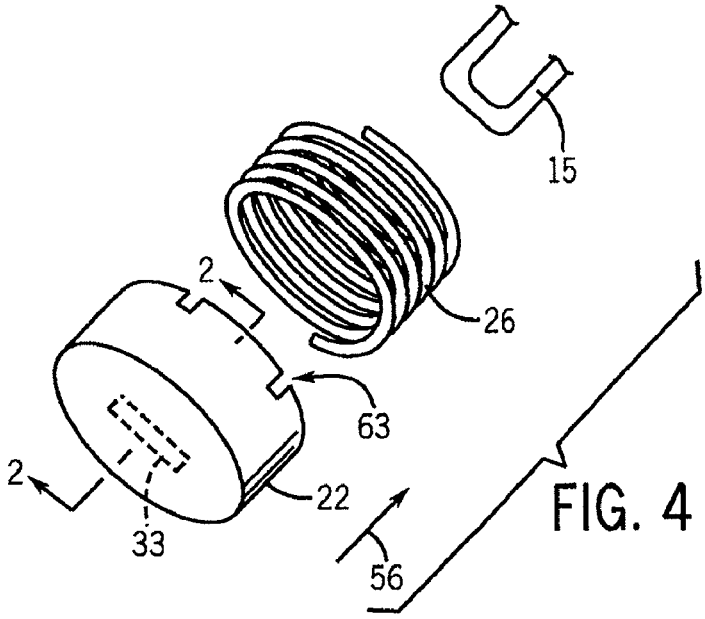
FIG. 4 is an exploded perspective view of the floating carriage as biased by a helical spring that may surround the strike.

Referring momentarily also to FIG. 4, the floating carriage 22 may be biased by a helical spring 26 applying a force on the floating carriage 22 directed generally inboard 28. The helical spring 26 may have sufficient diameter to fully surround the strike 15 and the hook cam 30 and may fit partially within a receiving circular slot 54 cut in the periphery of the floating carriage 22.

Referring now to FIG. 2, the hook cam 30 may include a hook portion 32, a constant radius portion 36, and an actuation arm 38. Before the strike 15 is received by the hook cam 30, the constant radius portion 36 abuts a stop 40 affixed to a latch frame 41 and generally fixed with respect to the cabinet 12. This abutment prevents inboard motion of the floating carriage 22.

The actuation arm 38 of the hook cam 30 is held by a slider 44 sliding along axis 24 as retained by the floating carriage 22 where it contacts the slider 44 at contact point 46. A front surface of the slider 44 extends radially inward from the outer periphery of the floating carriage 22 to a point closer to the pivot point 33 where it may contact the strike 15 at a contact point 48 closer to the pivot point 33 than is the contact point 46. Thus, the slider 44 allows the force of the strike 15 to be applied along a relatively greater lever arm distance 50 of the actuation arm 38 (between point 46 and pivot point 33) than the lever arm distance 52 provided by direct contact between the strike 15 and the hook cam 30 (between point 48 and pivot point 33). Note that the strike 15 must remain relatively close to the pivot point 33 so as to be engaged by the hook portion 32 as will now be described.

Figure 3:
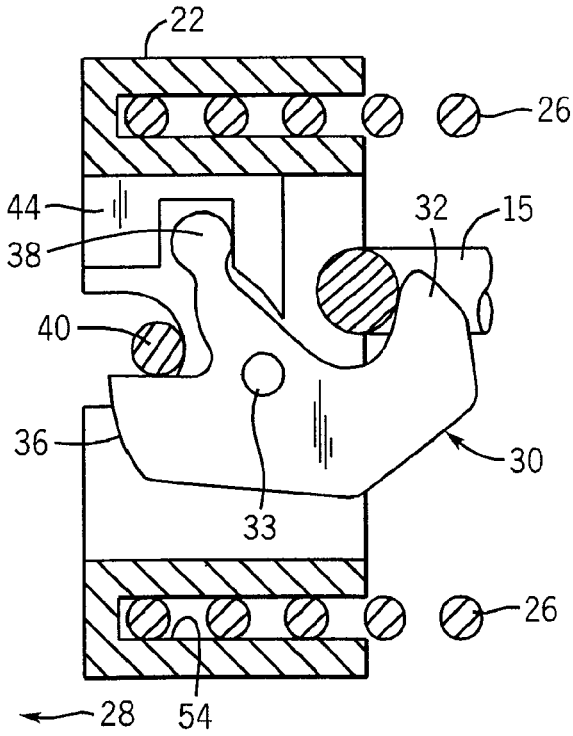
FIG. 3 is a figure similar to that of FIG. 2 showing the configuration of the floating carriage after receiving the strike and holding the door closed.

Referring to FIG. 3, as the strike 15 moves inward, it presses the slider 44 inboard which presses on the actuation arm 38 rotating the hook cam 30 in a counterclockwise manner so that hook portion 32 engages the strike 15 capturing it. This rotation causes the constant radius portion 36 of the hook cam 30 to move beyond the stop 40 allowing the floating carriage 22 to move inboard under the influence of the helical spring 26. It will be understood that the released energy from the helical spring 26 provides a compression of the door against the gasket (as shown in FIG. 1) and also allows greater amounts of inboard movement of the floating carriage 22 as the gasket ages.

The present invention incorporates by reference the disclosure of U.S. patent application 2005/0194795 to Kenyon A. Hapke et al., filed Sep. 8, 2005 and entitled: "Appliance Latch Having a Rotating Latch Hook Mounted on a Linear Slide" which describes an analogous locking system.

Figure 5:
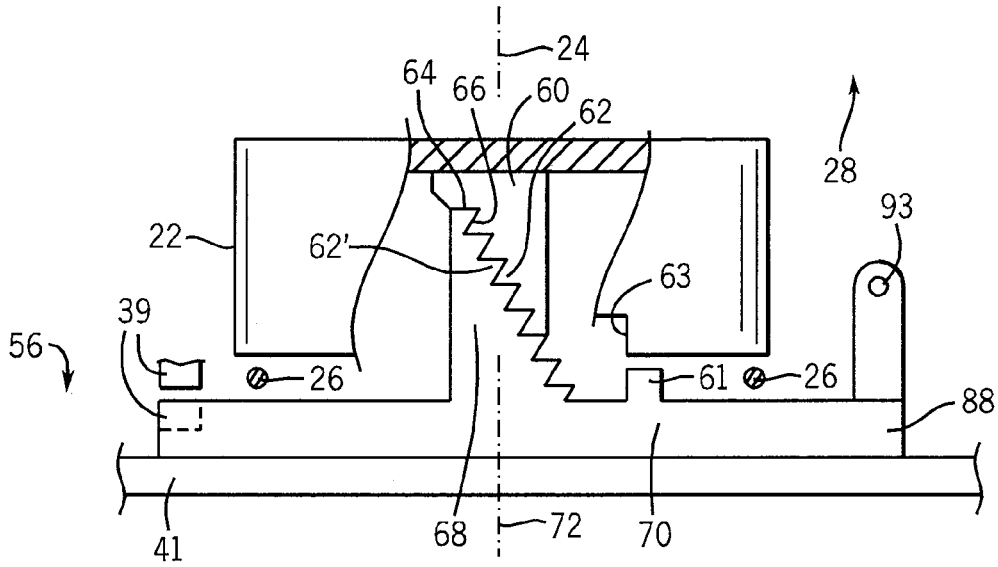
FIG. 5 is a plan view of the floating carriage in partial cut away to show inter-engaging ramps of a lock mechanism.
Figure 7:
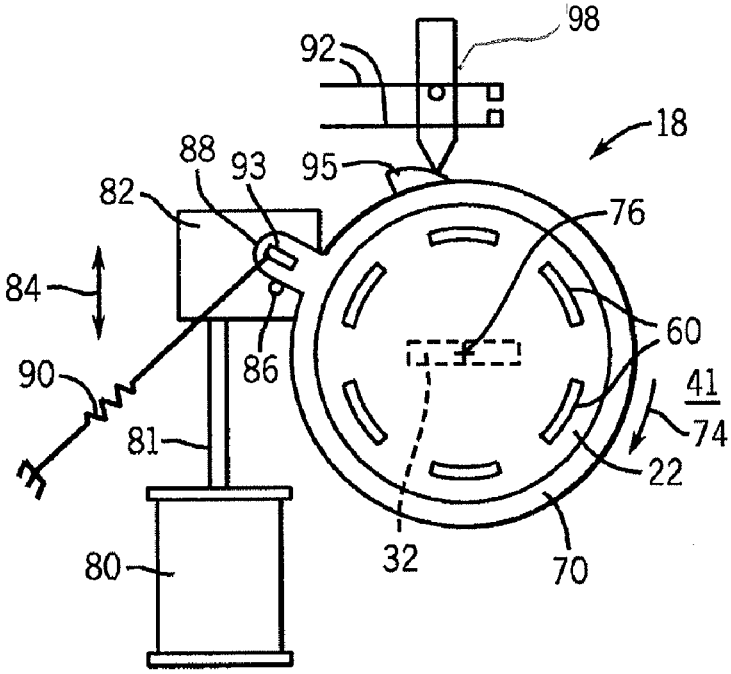
FIG. 7 is a front elevational view of the floating carriage positioned above a stop support next to an actuating mechanism implementing the lock of FIG. 5.

Referring now to FIGS. 3 and 5, it will be understood that the latch 18 may be locked by preventing motion outboard 56 by the floating carriage 22 sufficient to allow the hook cam 30 to move beyond the stop 40 thereby allowing clockwise rotational of the hook cam 30 to release the strike 15. In a preferred embodiment of the present invention, this blocking is accomplished by two mechanisms, first, a series of ramps 60 extending outboard from an underside of the floating carriage 22 and arranged generally at a constant radius about the center 72 of the floating carriage 22 as shown in FIG. 7. A face of each ramp 60 is sloped with respect to axis 24 and may have a set of teeth 62 having lateral faces 64 (perpendicular to axis 24) joined by oblique faces 66. These teeth 62 match corresponding teeth 62' on a series of corresponding stop ramps 68 attached to a stop support 70 and extending inboard 28. Rotation 74 (shown in FIG. 7) of the stop support 70 along a face of the frame 41 about the center 72 provides lateral motion that allows engagement or disengagement of the teeth 62, 62' for the multiple ramps 68 and 60. The stop support 70 and stop ramps 68 may be molded of thermoplastic material.

The second mechanism is a pre-stop 61 extending inboard from the stop support 70 and moving with rotation of the stop support 70 out of alignment with notches 63 on a lip of the floating carriage 22 to block its outboard motion. The pre-stop 61 positively locks the latch 18 but does not provide the gasket compensation provided by the ramps 60 and 62 as will now be described.

Figure 6A:
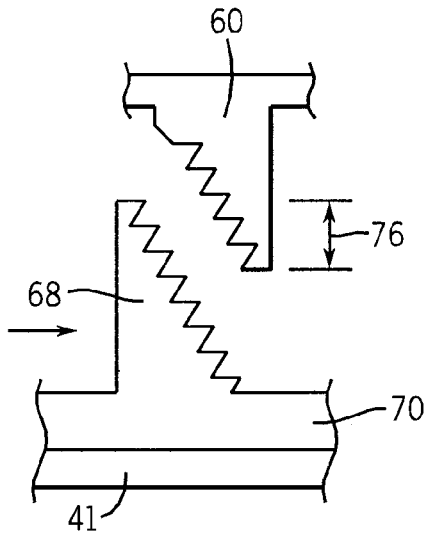
FIGS. 6*a*-6*c* are simplified representations of the ramps of FIG. 5 for two states of gasket aging and under compression of the door after locking, respectively.
Figure 6B:
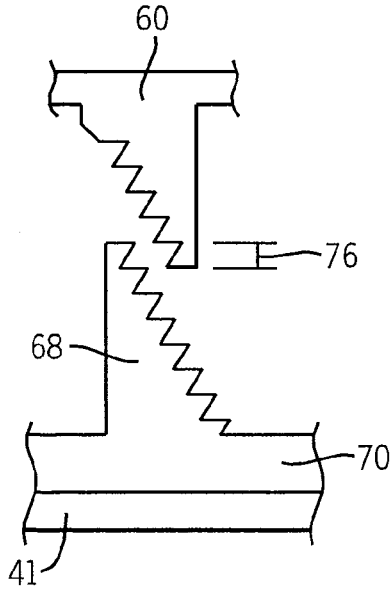

Referring now to FIGS. 1 and 6*a*, when the gasket 14 is new, ramps 60 engage ramps 68 with substantial overlap 76 because of the relatively outboard position of ramps 60 caused by the new gasket. In contrast, as shown in FIG. 6*b* as the gasket 14 ages, the overlap 76 decreases caused by shrinkage or reduced elasticity of the gasket 14. In either case, however, the overlap is sufficient to fully engage multiple of the teeth 62, 62' preventing further outward motion of the door 16 once the latch has been locked thus eliminating the possibility of leakage if the door is inadvertently pulled.

Figure 6C:
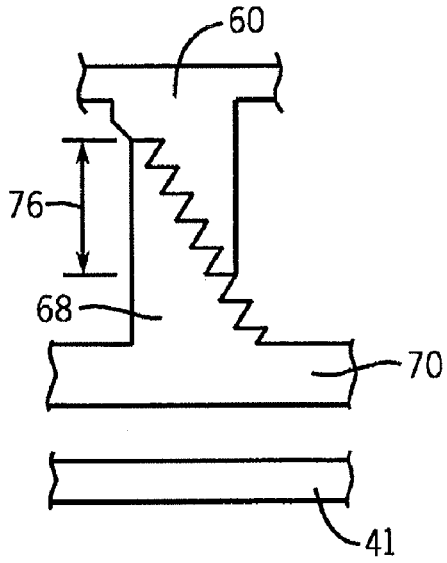

Referring now to FIGS. 1 and 6*c*, in the event that the door 16 is pushed inboard after the stop ramps 68 are engaged with the ramps 60, teeth 62, 62' ensure that the ramp 68 is pulled along with ramps 60 causing stop support 70 to be pulled away from the frame 41 accommodating this movement, and increased compression of the gasket 14 without allowing additional lateral motion of the stop support 70 or a decreasing of the overlap 76. In this way, increased forces between ramps 68 and 60 are avoided when the inboard force on the door 16 is released and stop support 70 abuts frame 41 again. Such increased force could prevent disengagement of the stop ramps 68 by the actuating mechanism as will be described below.

A guide track 39 returns the stop support 70 to abutment with the frame 41 after this inboard force when the stop is rotated to an unlocked position.

Referring now to FIG. 7, rotation of the stop support 70 about center 72 is provided by means of a single acting push solenoid 80 having an operator 81 moving a bi-stable mechanism 82 along actuation axis 84. As is understood in the art, the push solenoid 80 when energized extends its operator 81 and when de-energized provides no force on the operator 81 allowing it to remain where it is or be pulled back by a spring bias or gravity The bi-stable mechanism 82 provides an upwardly extending peg 86 that may abut an ear 88 (also shown in FIG. 5) attached to the stop support 70, pushing the stop support 70 in a clockwise direction when the bi-stable mechanism 82 moves upward along axis 84 with extension of operator 81. This clockwise motion is such as to disengage ramps 60 from stop ramps 68 with positive abutment of the peg 86 and ear 88.

On the other hand, the peg 86 may pull away from the ear 88 when the operator 81 retracts allowing the amount of rotation of the stop support 70 to vary as defined by engagement of the ramps 60 and 68 and the axial separation of the floating carriage 22 from the frame 41. A retraction spring 90 is attached to the ear 88 at attachment point 93 to provide a counterclockwise rotational bias to the stop support 70.

The bi-stable mechanism 82 may communicate directly with electrical contacts 92 that provide an indication of the state of lock or unlock of the latch 18. In a preferred embodiment, however, electrical contacts 92 are activated by a cam surface 95 extending radially from the stop support 70 to rotate therewith. The cam surface 95 activates a cam follower 98 activating the electrical contacts 92 allowing them to close when the latch 18 is locked.

Generally, the bi-stable mechanism 82 moves between an upward position (as shown in FIG. 7) disengaging the ramps 60 and 68 and a lowered position allowing engagement of the ramps 60 and 68 for every two cycles of energizing and de-energizing push solenoid 80. When push solenoid 80 is not energized, the bi-stable mechanism 82 remains in its last position (up or down) without the need for continued application of power to a coil of the push solenoid 80.

Figure 8A:
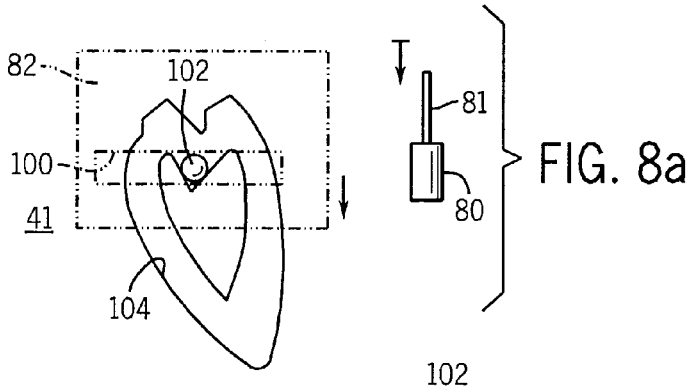
FIGS. 8*a*-8*d* are transparent views through a bi-stable element of the actuating mechanism shown in four stages of actuation depicted next to representations of the actuating solenoid and its operator.

Referring now to FIG. 8*a*, bi-stable mechanism 82 provides a linear slot 100 on its undersurface (shown in phantom in FIG. 8*a*) holding a steel ball 102 that may move left and right within the linear slot 100. The steel ball 102 is also partially held within a cardioid track 104 formed by an upper face of the frame 41 abutting the undersurface of the bi-stable mechanism 82. As shown in FIG. 8*a*, when solenoid 80 is de-energized with operator 81 extended, the ball 102 may rest between the two shoulders of the cardioid of cardioid track 104 trapped by the downward force of the spring 90 (shown in FIG. 7) and holding the bi-stable mechanism 82 in its upward state disengaging ramps 60 and 68 (shown in FIG. 5). No power needs to be applied to the coil of solenoid 80 to stably retain this state. It will be understood that the positions of the linear slot 100 and cardioid track 104 may be reversed with the cardioid track 104 on the undersurface instead of the linear slot 100.

Figure 8B:
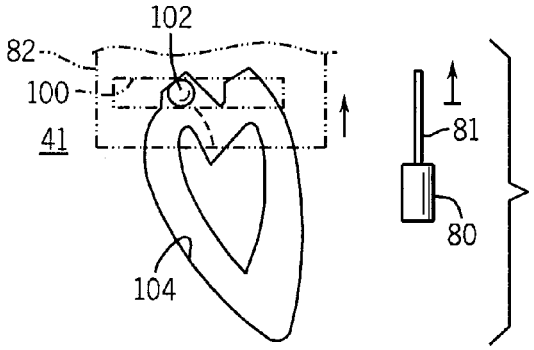
Figure 8C:
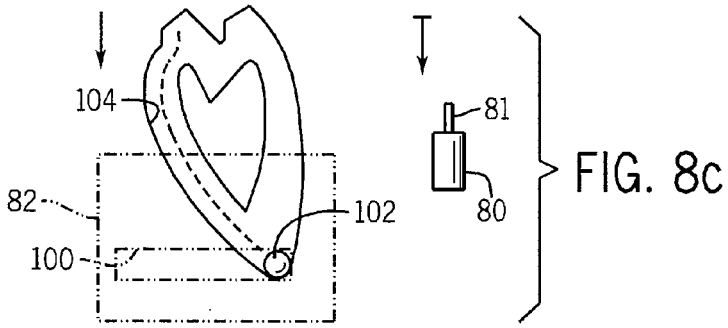

Referring now to FIG. 8*b*, when push solenoid 80 is next activated further extending operator 81, the ball 102 is forced upward into the left shoulder of the cardioid and moved slightly leftward from its previous position.

When the push solenoid 80 is deactivated the ball 102 may fall under vertical gravitational attraction and the influence of the track 100 along a left side of the cardioid track 104, allowing the bi-stable mechanism 82 to drop downward and allowing the ramps 60 and 68 to engage. In this lower state, again, no power need be applied to the push solenoid 80.

Figure 8D:
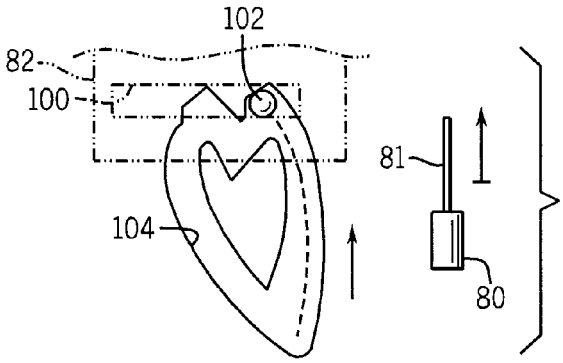

Referring now to FIG. 8*d*, when the push solenoid 80 is energized for a second time, operator 81 extends upward allowing the ball 102 to pass up the right side of the cardioid track 104. When power is released from the push solenoid 80, the ball 102 will drop into its position shown in FIG. 8*a* and the cycle will be complete and repeatable. Thus, a single push solenoid 80 may provide for two states of lock and unlock without requiring power when those states have been attained.

It will be understood that elements of these particular embodiments may be mixed and matched. Thus, for example, the adjustable stop system of FIGS. 5 and 6*a*-6*c* (embodiment A) may be used with or without the increased lever provided by the actuation arm on the hook cam of FIGS. 2 and 3 (embodiment B) and the bi-stable actuator of FIGS. 7, 8*a*-8*d* (embodiment C), each of which may also be used alone or in combination with the other embodiments.

Further, it should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A latch for locking an appliance, said latch arranged for receiving a strike along an axis to hold a door of the appliance closed, a portion of the appliance having a gasket to cooperate with the door, said latch comprising: a latch frame affixable to the portion of the appliance; a carriage held by the latch frame and axially spring biased in a door closing direction; a hook cam carried by the carriage to releasably engage the strike to pull the door against the gasket under a spring biasing action of the carriage; a stop assembly movably fitted between the carriage and the latch frame to bridge an axial separation between the carriage and latch frame; and an electric actuator for moving the stop assembly between a locked position in which the stop assembly bridges the axial separation between the carriage and the latch frame to block movement of the carriage in a door opening direction, and an unlocked position in which the stop assembly does not bridge the axial separation between the carriage and the latch frame, wherein the stop assembly includes at least one stop wedge, the carriage includes at least one carriage wedge corresponding to the stop wedge, and the at least one stop wedge being laterally movable perpendicular to the axial separation between the carriage and the latch frame into cooperation with the at least one carriage wedge to bridge the axial separation between the carriage and the latch frame when the stop assembly is in the locked position.

2. The latch of claim 1, wherein the at least one stop wedge includes a set of teeth engaging corresponding teeth of the at least one carriage wedge on the carriage.

3. The latch of claim 2, wherein the teeth have lateral faces.

4. The latch of claim 1, wherein the stop assembly is moveable in a rotary motion to define the axial separation between the carriage and the latch frame.

5. The latch of claim 1, wherein the stop assembly includes multiple wedges rotatable about a common center, and the carriage includes corresponding wedges to laterally engage the wedges on the stop assembly to bridge the axial separation between the carriage and the latch frame when the stop assembly is in the locked position.

6. The latch of claim 1, further comprising:

a helical spring causing the spring biasing action of the carriage, said spring arranged for surrounding the hook cam and the strike when the hook cam and the strike are engaged.

7. The latch of claim 1, wherein the stop assembly is attached to the carriage when in the locked position to block movement of the carriage in the door opening direction.

8. The latch of claim 1, further comprising: a guide track for returning the stop assembly to the unlocked position.

9. The latch of claim 1, wherein the carriage and the stop assembly are constructed of moldable thermoplastic.

10. A latch for retaining a strike to hold a door of an appliance closed, a portion of the appliance having a gasket to cooperate with the door, said latch comprising:

a latch frame affixable to the portion of the appliance;

a biasing spring;

a carriage held by the latch frame and spring biased by the biasing spring in a door closing direction;

a hook cam carried by the carriage to releasably engage the strike to pull the door against the gasket under the spring biasing action of the biasing spring;

wherein the hook cam includes:

(a) a hook portion for engaging the strike;

(b) a substantially constant radius portion for abutting a stop fixed to the latch frame before the hook portion engages the strike to hold the carriage against the spring biasing action of the biasing spring; and (c) an actuation arm for rotating the hook cam through a force applied at a first point on the actuation arm upon the closing the door, the first point on the actuation arm being outside a second point of contact between the strike and the latch measured from a pivot point of the hook cam, wherein a stop assembly movably fitted between the carriage and the latch frame to bridge an axial separation between the carriage and latch frame; and an electric actuator for moving the stop assembly between a locked position in which the stop assembly bridges the axial separation between the carriage and the latch frame to block movement of the carriage in a door opening direction, and an unlocked position in which the stop assembly does not bridge the axial separation between the carriage and the latch frame, wherein the electric actuator includes:

an electrical solenoid energizable to provide an actuation force in only a single actuation direction; and a bi-stable mechanical linkage attached between the electrical solenoid and the stop assembly to move the stop assembly to the locked position with an initial actuation force and release of the initial actuation force, and to move the stop assembly to the unlocked position with a subsequent actuation force and release of the subsequent actuation force, wherein the bi-stable mechanical linkage comprises a follower and a cardioid track traversed by the follower with one of the track and the follower fixed with respect to the latch frame, and another track formed in a body of the bi-stable mechanical linkage in which the follower, which is a ball, is held, said another track being located perpendicular to the actuation direction such that the body of the bi-stable mechanical linkage moves along the cardioid track through the traversal of the cardioid track by the follower.

11. The latch of claim 10, further comprising:

a sliding element holding the actuation arm and arranged for contacting the strike at the second point and contacting the actuation arm at the first point.

12. The latch of claim 10, wherein the hook cam is constructed of moldable thermoplastic.

13. A latch for receiving a strike to hold a door of an appliance closed, the latch comprising:

a latch frame affixable to a portion of the appliance;

a hook assembly carried by the latch frame to engage the strike by moving from a first position to a second position and to release the strike by moving from the second position to the first position;

a stop assembly movable to a locked position to block movement of the hook assembly from the second position to the first position, and movable to an unlocked position to allow movement of the hook assembly from the second position to the first position; and an actuator assembly for moving the stop assembly between the locked position and the unlocked position, the actuator assembly comprising:

(a) an electrical solenoid energizable to provide an actuation force in only a single actuation direction; and (b) a bi-stable mechanical linkage attached between the electrical solenoid and the stop assembly to move the stop assembly to the locked position with an initial actuation force and release of the initial actuation force, and to move the stop assembly to the unlocked position with a subsequent actuation force and release of the subsequent actuation force, wherein the bi-stable mechanical linkage comprises a follower and a cardioid track traversed by the follower with one of the track and the follower fixed with respect to the latch frame, and another track formed in a body of the bi-stable mechanical linkage in which the follower, which is a ball, is held, said another track being located perpendicular to the actuation direction such that the body of the bi-stable mechanical linkage moves along the cardioid track through the traversal of the cardioid track by the follower.

14. The latch of claim 13, further comprising:

a spring biasing the stop assembly in a direction opposed to the direction of the initial and subsequent actuation forces.

15. The latch of claim 13, wherein the bi-stable mechanical linkage is configured to control a spring biasing action of the stop assembly, allowing the stop assembly to be mechanically decoupled from the bi-stable mechanical linkage.

16. The latch of claim 13, wherein the solenoid has an extensible operator arranged to extend with energizing of the solenoid.

17. The latch of claim 13, further comprising:

at least one switch contact coupled to the stop assembly.

* * * * *